US005649571A

United States Patent [19]

Miyahara et al.

[11] Patent Number: 5,649,571

[45] Date of Patent: Jul. 22, 1997

[54] SUB-NOZZLE IN AN AIR INJECTION TYPE WEAVING MACHINE

[75] Inventors: Michito Miyahara; Shinya Baba, both of Fukuoka; Masahiro Okesaku; Ikuo Takashima, both of Komatsu, all of Japan

[73] Assignees: Nippon Tungsten Co., Ltd., Fukuoka; Hokuriku Seikei Industrial Co., Ltd., Ishikawa, both of Japan

[21] Appl. No.: 495,687

[22] PCT Filed: Dec. 26, 1994

[86] PCT No.: PCT/JP94/02213

§ 371 Date: Jul. 24, 1995

§ 102(e) Date: Jul. 24, 1995

[87] PCT Pub. No.: WO95/18253

PCT Pub. Date: Jul. 6, 1995

[30] Foreign Application Priority Data

Dec. 28, 1993 [JP] Japan ..... 5-336879

[51] Int. Cl.[6] ..... D03D 47/30

[52] U.S. Cl. ..... 139/435.5; 139/435.4; 239/DIG. 19

[58] Field of Search ..... 139/435.5, 435.4; 239/583, 569, DIG. 19; 226/97; 28/272

[56] References Cited

FOREIGN PATENT DOCUMENTS

| | | | |
|---|---|---|---|
| 50-123938 | 9/1975 | Japan . | |
| 60-209050 | 10/1985 | Japan . | |
| 62-28887 | 2/1987 | Japan . | |
| 63-211346 | 9/1988 | Japan . | |
| 0211346 | 9/1988 | Japan | 139/435.5 |
| 63-264947 | 11/1988 | Japan . | |
| 0264948 | 11/1988 | Japan | 139/435.5 |
| 1321262 | 12/1989 | Japan . | |
| 4310540 | 11/1992 | Japan . | |
| 405044139 | 2/1993 | Japan | 139/435.5 |
| 405117938 | 5/1993 | Japan | 139/435.5 |
| 59106541 | 6/1994 | Japan . | |

*Primary Examiner*—Andy Falik

*Attorney, Agent, or Firm*—Jordan and Hamburg

[57] ABSTRACT

A sub-nozzle in an air injection type weaving machine in which fluffing or the like caused by contact thereof with warp etc. does not occur, and for which its manufacture and control is facilitated. A sub-nozzle jetting a high-speed air flow for acceleration toward weft thrown from a main nozzle to between warps when they are raised and lowered to form shed opening comprises a holder connected to the side of a supply source of compressed air and a nozzle head connected to the holder, where at least the nozzle head is integrally formed by a high-strength glass material and occurrence of warp damage or wear of the nozzle head per se is restrained by the smoothness of its surface.

3 Claims, 3 Drawing Sheets

SUB-NOZZLE IN AN AIR INJECTION TYPE WEAVING MACHINE

FIELD OF ART

The present invention relates to a sub-nozzle integrated in an air injection type weaving machine for accelerating weft in warp openings by air injection flow.

BACKGROUND OF THE INVENTION

In an air injection type weaving machine among automatic weaving machines of a fluid injection type, a sub-nozzle jetting high-speed air flow is installed in addition to a main nozzle for wefting. This sub-nozzle prevents weft supplied from the main nozzle from stalling when it is flying in openings of warp. A nozzle head goes in and out of the openings of warp in an oscillating motion to provide an injection timing of air synchronized with the flying of weft.

A typical structure of such a sub-nozzle includes a distal end of a pipe with a blind hole formed by a deeply drawn metal plate, which is flattened where an injection hole of air is opened.

The most serious problem in using a sub-nozzle is that the surface of the nozzle head thereof is brought into contact with warp in oscillation, causing wear of the nozzle head or damage of warp. Burrs or the like are apt to occur on the surface of a sub-nozzle made of a metal and their adverse influence on warp has been unavoidable.

To resolve these problems a hard film is formed on the surface of the sub-nozzle to increase wear resistance as disclosed in Japanese Unexamined Patent Publication No. Sho 59-106541. Further, a sub-nozzle in which the nozzle head is formed by a composite material (cermet) of metal and ceramics has already become known as described in Japanese Unexamined utility model Publication No. Sho 62-28887.

Further, according to Japanese Unexamined Patent Publication No. Sho 63-264947 there has been proposed a sub-nozzle in which the nozzle head thereof is integrally formed by a partially stabilized zirconia ceramic to prevent damage of the warp by contact with the surface of the sub-nozzle, in which the total surface constitutes one smooth face to prevent fluff of warp.

However, in a sub-nozzle on which a surface treatment of hard film is provided, metal matrix may be exposed by partial separation, wear of the hard film due to deterioration, or lowering of other mechanical strengths etc. It is highly possible that warp is damaged by being caught at the exposed portions.

Meanwhile, in a sub-nozzle in which the nozzle head is integrally formed by cermet or ceramics, a sufficiently favorable result has been obtained with respect to wear resistance, and its influence on warp is insignificant.

However, it is indispensable that a nozzle head be provided with mechanical strength when forming a sub-nozzle of such a material. Therefore, a strong and dense material is required, and very careful flow control is necessary in manufacturing from the raw material powder stage to the final forming stage. Further, a thin-walled product has been required to respond to the downsizing of nozzle heads. In such a thin-walled product, deformations or cracks thereof occur and, further, a number of defective products caused by dispersion of the shrinkage rate in sintering, over-sintering, or under-sintering are brought about. Further, since a nozzle made of cermet or ceramics is especially hard, numerous lapping steps are required to decrease the surface roughness of the nozzle head.

As stated above, warp is adversely influenced by a sub-nozzle in which the surface of the nozzle head is treated by a hard film, whereas in a sub-nozzle in which the nozzle head is integrally formed by cermet or ceramics, there are a number of manufacturing problems in yield, working steps, and quality control which increase the production costs in comparison with those of nozzles made of metal.

It is an object of the present invention to provide a sub-nozzle for an automatic weaving machine which does not cause fluffing or the like through contact with warp, and for which manufacturing control is facilitated.

DISCLOSURE OF INVENTION

The present invention provides a sub-nozzle for jetting a high-speed air flow for acceleration toward weft thrown from a main nozzle to between warps, wherein a nozzle head formed by a glass material is installed in a holder communicating with the supply source side of the high-speed air flow.

For the glass material, chemically strengthened glass, crystallized glass, fiber reinforced glass and composite materials of glass/ceramics having a glass component as the matrix can be utilized. Further, recently developed composite materials of glass and synthetic resin, and fiber reinforced glass are applicable and preferable thereto, since they have good wear resistance and strengths superior to those of general glass materials.

A smooth surface made of a glass luster face can be obtained by integrally forming the nozzle head from a strong glass group material. Because of its smoothness, even if it is brought into contact with warp, the warp will be undamaged. Further, the surface wear of the nozzle head per se is restrained.

A publicly-known blow method, press method, press and blow method and vacuum suction forming method, as well as casting and injection molding which have widely been adopted in manufacturing glass products, are applicable to forming the nozzle head from the above-mentioned glass group material. In comparison with powder metallurgy methods using cermet or ceramics material, in these forming methods, steps of sintering at high temperatures and lapping of the surface can be dispensed with, thereby allowing high yields and high productivity.

The following effects can be achieved by the above-explained present invention.

a. The nozzle head of the sub-nozzle is formed by using a glass material and therefore, unlike conventional cermet, ceramic or metallic materials, steps of sintering at high temperatures and lapping of the surface can be dispensed with, considerably reducing production costs.

b. The surface of the nozzle head is constituted of a glass luster face and therefore, no fluffing or damage of warp occurs even if the nozzle head is brought into contact with warp, and adherence of stain on the surface of the nozzle head can be prevented by the dense structure of the glass material.

c. The peripheral wall of an inner flow path of the nozzle head is constituted a smooth surface with a glass luster and therefore, flow resistance against passing air is considerably reduced when compared to ceramics or the like, and a high-speed air flow with minimal pressure loss can be achieved.

d. The specific weight of the glass material is approximately 2.5 to 3.5 lighter than metal, zirconia ceramics or the like and therefore, the inertia of the sub-nozzle in oscillation is reduced, accordingly reducing stress acting on the boundary of the nozzle head and the holder, by which the mechanical abrasion of various parts can be alleviated.

DESCRIPTION OF THE PREFERRED EMBODIMENT

Figure 1:
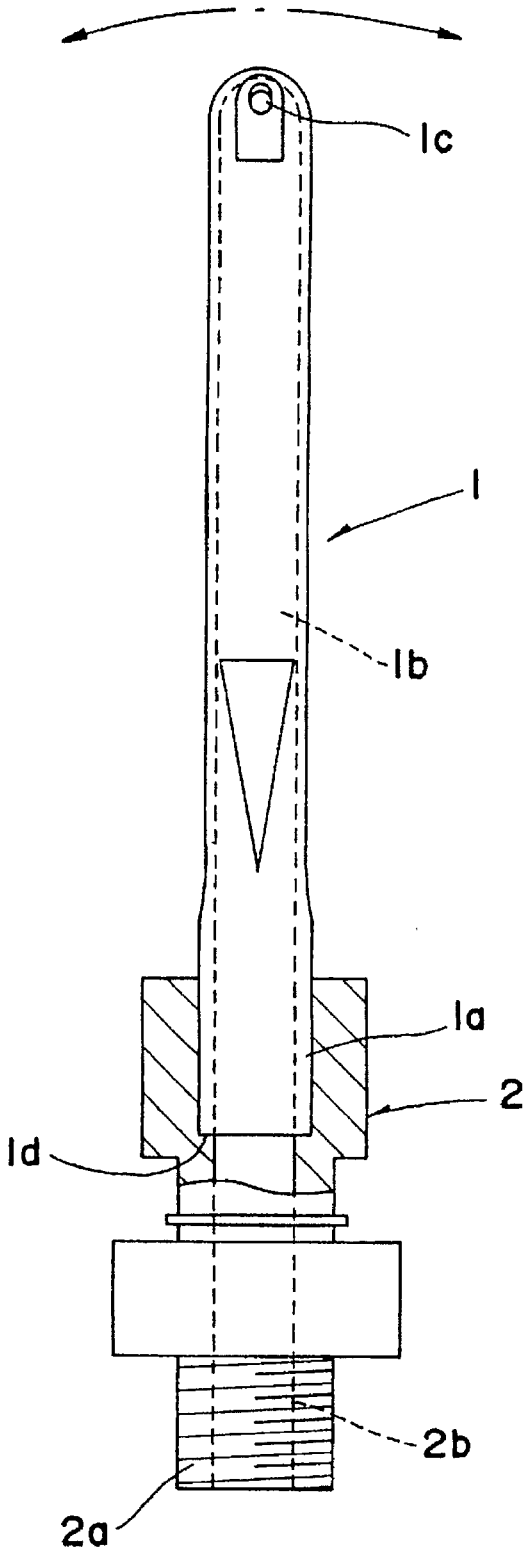
FIG. 1 is a partially broken front view of parts showing an embodiment of a sub-nozzle according to the present invention.
Figure 2:
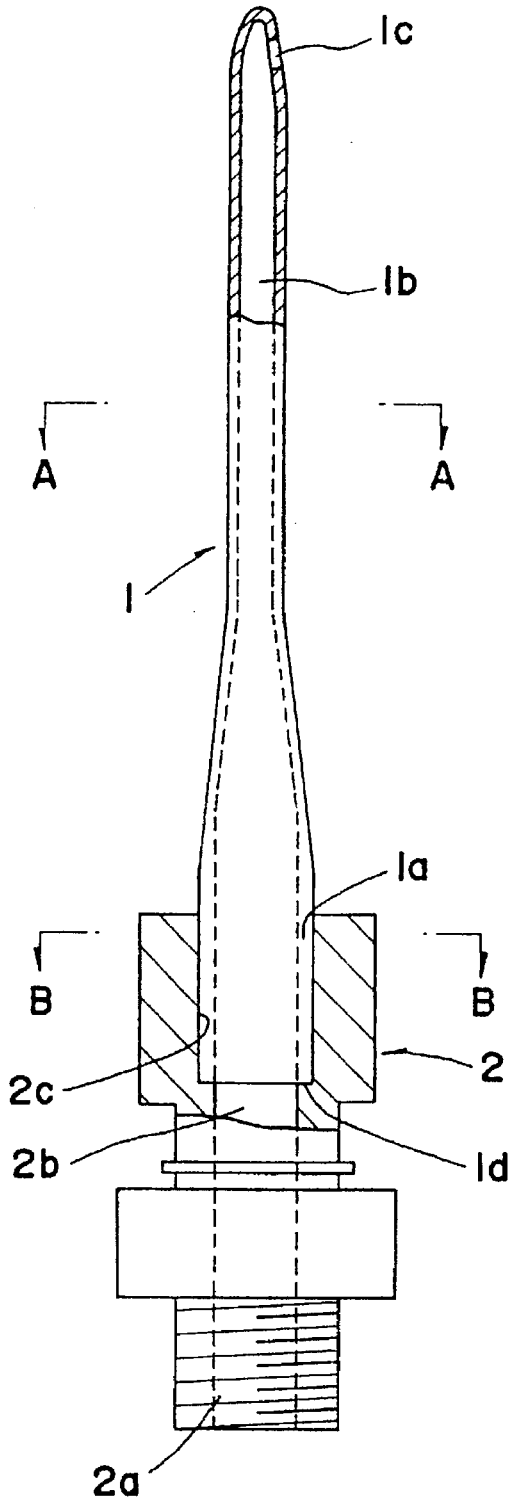
FIG. 2 is a partially broken left side view of the sub-nozzle shown in FIG. 1.
Figure 3A:
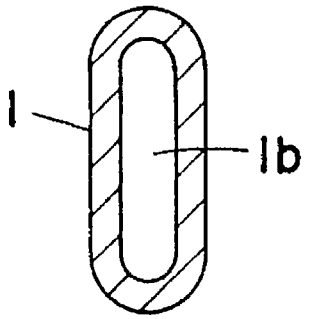
FIGS. 3(*a*) and 3(*b*) are transverse sectional views respectively taken along lines A—A and B—B in FIG. 2.
Figure 3B:
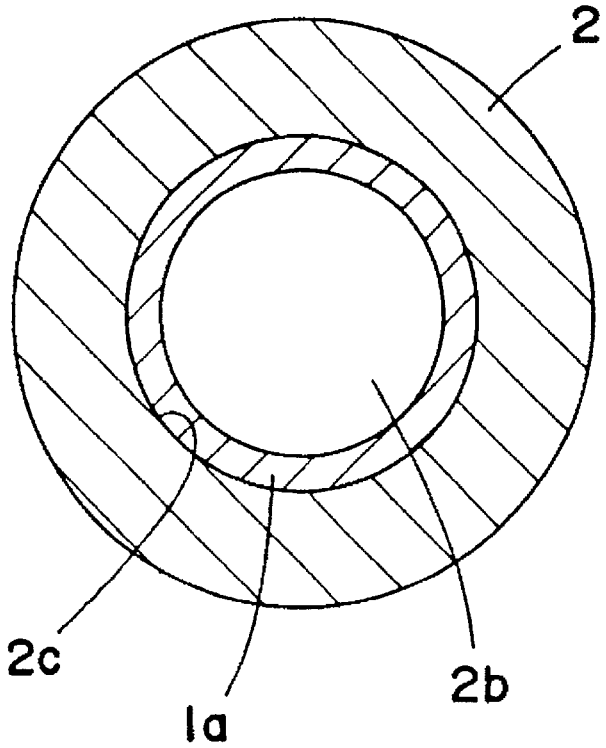

In FIG. 1 and FIG. 2, a sub-nozzle comprises a nozzle head 1 and a holder 2 made of a metal fixedly holding the nozzle head 1. In the holder 2, a screw 2*a* is formed at its base end portion and a supply path 2*b* of air flowing to the nozzle head 1 is opened in the axial direction. Further, the supply path 2*b* is connected to the side of a supply source (not shown) of compressed air by the screw 2*a*, and the holder 2 is connected to a mechanism for oscillating the sub-nozzle in an arrow-marked direction as shown by the dotted chain line of FIG. 1. As with a conventional sub-nozzle, the attitude of the nozzle head 1 is set by the holder 2, whereby the nozzle head 1 can easily enter between warp ends when they are raised and lowered to form a shed opening and the direction of air injection is properly aligned. The nozzle head 1 has the function of accelerating weft flying between the warps by the oscillating motion and the jetting of air from the nozzle head 1. The nozzle head 1 is formed by high strength glass such as chemically strengthened glass, crystallized glass, glass ceramics, or a glass composite material mixed with glass and SiC (silicon carbide) fibers or resin components. Further, with respect to shape, the nozzle head 1 has a base end portion 1*a* fixed to the holder 2, a distal end side thereof is in a flat configuration, and a flow path 1*b* communicating with the supply path 2*b* of the holder 2 is formed at its inner portion at the distal end of which an injection hole 1*c* is opened. In reference to FIGS. 3(*a*) and 3(*b*) respectively showing transverse sectional views taken along lines of A—A and B—B of FIG. 2, the base end portion 1*a* fitted to the holder 2, has an annular section which gradually converges from the base end portion 1*a* into a flat, hollow, midway section as shown in FIG. 3(*a*). Although the wall thickness of the nozzle head 1 may generally stay the same throughout its entire body, as in those made of metal or ceramics, it is preferable in oscillation at a very high speed that the wall thickness of the base end portion 1*a* be approximately 1.5 to 2 times as large as the wall thickness of the flat portion of 0.3 to 0.4 mm (specifically, a wall thickness of approximately 0.45 to 0.8 mm) as shown in FIG. 1 and FIG. 2.

The nozzle head 1 is fitted to a fitting seat 2*c* provided at the front end of the holder 2 by inserting a fixing seat 1*d* provided at the lower end of the base end portion 1*a* thereinto, and fixed and sealed thereto with a suitable adhesive agent, O-ring or the like. Such an integrated sub-nozzle repeats an oscillating motion in accordance with the rotation of a cam generating a sinusoidal motion. Since stress given to the nozzle head 1 by the oscillating motion concentrates on the boundary of the nozzle head 1 and the holder 2, the bending strength of the glass material is ideally over 200 MPa, more preferably 250 MPa or more, in consideration of its moment of inertia. MPa stands for "mega Pascal" which is a unit of pressure now used in this field instead of kg/cm$^2$ or other units that were used before. Further, the safety factor of breakage resistance can be promoted by determining the wall thickness of the base end portion to be 0.45 to 0.8 mm, so that the boundary portion will not be broken by stress concentration.

Further, with respect to bending stress acting in accordance with the oscillation of the sub-nozzle, the strength of the base end portion 1*a* is enhanced and the safety factor against the breakage of the boundary portion of the sub-nozzle and the holder can be promoted by determining the wall thickness of the base end portion 1*a* to be a pertinent thickness in a range of 0.45 to 0.8 mm.

In chemically strengthened glass, compression strain layers are formed on the surface of the glass by dipping borosilicate glass, aluminosilicate glass mixed with borosilicate glass and aluminium oxide or the like in a salt solution of potassium nitrate heated to approximately 300° to 500° C. for a long period of time, by which sodium ions are exchanged with potassium ions, a material having a mechanical strength as much as ten times that of normal glass. It is appropriate to use glass code No. 0317 of Corning Glass Company for these chemically strengthened glass materials.

Further, in forming the nozzle head 1 with chemically strengthened glass, steps must be adopted wherein after forming it in a shape and dimension having no air injection hole, an injection hole 1*c* is bored by a diamond drill followed by chemical strengthening. If the boring or other mechanical work is performed to form the injection hole after chemical strengthening, cracks or chips are caused releasing compression strain on the surface layer. In this situation, an accurate injection hole or an end face of the base end portion cannot be formed.

Further, in crystallized glass, when a crystal nucleus formation and crystal growth are carried out on crystals of tetragonal zirconia, β-spodumene solid solution, potassium mica or calcium mica etc. in a lithium·alumina·silica group matrix or magnesia·alumina·silica group matrix by a reheating treatment of a glass in which cracks are inhibited, the mechanical strength thereof will greatly. exceed that of normal glass and therefore, the glass can be used in a nozzle head.

However, in forming a nozzle head of crystallized glass, after forming the nozzle head from molten glass crystal, a precipitation treatment is performed by maintaining it at temperatures of 750° to 900° C. (that is, not less than the softening point) for 0.5 to 4 hours. The crystal precipitation treatment should be conducted at the lowest possible temperature to inhibit deformation of the nozzle held. As one method of preventing deformation, the treatment is performed with the side for the injection hole facing down, in a state wherein a core is inserted into the glass by which said side thickens, producing a shape that stabilizes the direction of air injection. Further, when deformation is considerable, a desired nozzle can be provided by reversing the glass position in upward and downward directions at set intervals.

Crystallized glass belongs to a category of glass ceramic materials. An example of components is 40% $SiO_2$-40% MgO-12% $A_2O_3$-6% $Na_2O$-1.5$ZrO_2$-0.5ZnO in conversion of oxides further containing fluoride of approximately 20%, which has a bending strength of 250 MPa or more.

The blow method is applicable to manufacturing the nozzle head 1 by using these glass materials. The blow method is utilized in manufacturing of, for example, glass mugs, incandescent bulbs or the like, wherein a glass gob that has been preliminarily formed by a press method is put between halves of a divided mold, and molding is performed by pushing the gob on the inner wall of the divided mold by blowing air into the gob, drawing it from the divided mold. In such a blow method, the wall thickness of a manufactured product can be reduced and changed at portions thereof and therefore, the method is sufficiently applicable to manufacturing the nozzle head 1 according to this embodiment.

Further, as a substitute for the blow method, molten glass is injected into a bottom mold having a cavity corresponding to the outer dimensions of the nozzle head 1, which is pressed by a core having a surface shape corresponding to the inner face shape of the nozzle head 1. Thereby, the nozzle head 1 is formed in a gap between the bottom mold and the core. Further, the nozzle head 1 can be formed by putting a gob of molten glass or a parison formed from a glass tube in a bottom mold (finishing mold) and sucking the inside of the bottom mold in vacuum.

Further, manufacturing can similarly be performed by casting or injection molding. Meanwhile, a nozzle head of fiber reinforced glass material can be provided by a direct forming method in which publicly known SiC fibers, which are mixed in whisker reinforced ceramic material that has drawn recent attention, are uniformly distributed in a sol/gel of a glass component. The mixed material is then cast, dried and sintered, or a method in which a slurry that is formed by drying and sintering a sol dispersed with SiC fibers and then crushing the sintered material by a bead mill using $ZrO_2$ beads, is formed into a nozzle shape by casting or the like, with the formed material being sintered at temperatures of 600° to 1,200° C. A nozzle head made of fiber reinforced glass is preferable since its bending strength is no less than 300 MPa. Accordingly, in manufacturing the sub-nozzle with such a high strength glass or glass composite material, the yield can be enhanced since cracking failures and inferior sinter products in the forming step or sintering step often observed in ceramics materials are rare. Further, the surface of the product comprises a glass luster face and therefore, surface roughness is confined within an extremely small range and the lapping step is made redundant.

The nozzle head 1 formed by the above-mentioned glass group material and manufacturing method is provided with an outer surface and inner wall surface of the flow path 1*b*, with a uniformly smooth glass luster face having a surface roughness of 0.55 or less. A surface roughness of "0.5S" means a surface roughness having 0.5 μm at the maximum according to the Japanese Industrial Standard, JIS B 0601-1994. In the Standard, the maximum height of surface roughness is designated as μm R max or simply as S. Accordingly, even if the nozzle head 1 is brought into contact with warp while oscillating as shown in FIG. 1, no fluffing or damage is caused. Further, the inner wall of the flow path 1*b* is similarly provided with a smooth surface having a glass luster and therefore, the frictional resistance of pipe against the high-speed air flow decreases, and a high-speed air flow of minimal pressure loss can be effectively jetted.

Further, the nozzle head 1 has high wear resistance in comparison with metal materials and, at the same time, the sliding performance of the warp with respect to the surface is excellent, thus limiting by which the surface wear and prolonging service life.

Further, the conventional product of cermet or ceramic materials is manufactured by the powder metallurgy method and therefore, its yield is insufficient even if rigid flow control is performed from the raw material stage to the final product.

By contrast, in the present invention, the nozzle head 1 can be formed by the blow method, the press method, the casting method, the injection molding method or the like using glass materials and therefore, a uniform quality product can be manufactured with improved yield. Further, even in the case where the glass material is molten, the product can be formed at relatively low temperatures in comparison with conventional cermet or ceramic materials thereby providing energy conservation and reduced production costs.

Further, the specific weight of glass material is approximately 3, less than half that of metal or zirconia ceramic. Therefore, the energy required for oscillating the sub-nozzle is minimized and damage to the weaving machine can be alleviated.

Although the sub-nozzle of the present invention can be used by integrating it with an air injection type weaving machine for accelerating weft in openings of warp by an injection air flow, it is applicable for use with any type of air injection weaving machine.

We claim:

1. A sub-nozzle in an air injection type weaving machine jetting a high-speed air flow for acceleration toward weft thrown from a main nozzle to between warps, comprising a holder connected to a supply source of the high-speed air flow and a nozzle head formed by a glass material, said nozzle head being provided with a glass luster face having a surface roughness of 0.5S or less on an inner face and an outer surface thereof.

2. The sub-nozzle in an air injection type weaving machine according to claim 1, wherein the glass material is selected from the group consisting of a chemically strengthened glass, a crystallized glass, a glass ceramic material and an SiC whisker-reinforced glass.

3. The sub-nozzle in an air injection type weaving machine according to claims 1 or 2, wherein said nozzle head has a base end portion and a distal flat end portion, the wall of said base end portion having a thickness of 0.45 to 0.8 mm, which is 1.5 to 2 times larger than the thickness of the wall of said flat end portion.

* * * * *